United States Patent [19]

Eversole, Jr.

[11] Patent Number: 4,738,641

[45] Date of Patent: Apr. 19, 1988

[54] TRAILER ELECTRICAL CONNECTOR PROTECTOR DEVICE

[76] Inventor: William F. Eversole, Jr., Star Route, 440 Two Valley Rd., Shoshoni, Wyo. 82649

[21] Appl. No.: 71,900

[22] Filed: Jul. 10, 1987

[51] Int. Cl.[4] ..... H01R 13/60

[52] U.S. Cl. ..... 439/528; 248/314; 280/421; 439/34

[58] Field of Search ..... 439/34, 35, 135, 136, 439/517, 528; 280/421, 422; 248/314

[56] References Cited

U.S. PATENT DOCUMENTS

| | | | |
|---|---|---|---|
| 3,176,257 | 3/1965 | Introvigne | 439/528 |
| 3,482,203 | 12/1969 | Whitright | 439/528 |
| 3,577,115 | 5/1971 | Whitright | 439/528 |
| 4,278,226 | 7/1981 | Horowitz | 280/421 X |
| 4,366,965 | 1/1983 | Rhodes | 439/34 X |
| 4,624,472 | 11/1986 | Stuart et al. | 439/34 X |

*Primary Examiner*—Eugene F. Desmond

*Attorney, Agent, or Firm*—Richard C. Litman

[57] ABSTRACT

A trailer electrical connector plug storage and protective device includes a sectioned tubular retainer housing containing a spring urged resilient concaval disk. The disk is disposed downward, under the action of the retainer housing spring, biasing the disc against a male electrical plug connector that is seated in the tubular retainer housing. A pivotably fastened protective cover is mounted on the tubular retainer housing such that the male electrical plug is covered and thereby protected from the elements of rain, moisture, or dirt.

3 Claims, 2 Drawing Sheets

TRAILER ELECTRICAL CONNECTOR PROTECTOR DEVICE

BACKGROUND OF INVENTION

Field of Invention

This device relates to electrical plug connectors and protective devices and specifically to those devices for the temporary storage and protection of electrical plugs such as are found on trailers.

State laws require that trailers have working turn signal lights and brake and running lights for safety while on the road. This requires an electrical harness and plug adaptor to carry the current from the towing vehicle to the trailer. The harness and plug connector are disconnected when the trailer is detached from the vehicle.

For the most part, these connector plugs and leaders are wrapped around the trailer tongue, or allowed to drop down to earth where moisture, water, and dirt act to corrode and oxidize the electrical components, such as copper, of the plug connector. The present device offers storage and protection for the trailer connector at those times the trailer is not in use.

The present invention provides a construction and a method for conveniently affixing the loose plug connector into a housing, which protects it from rain, snow and blowing dirt. By using this device, the plug life is increased and also protected from accidental damage, as by the trailer tongue dropping down onto the plug.

The present device accomplishes the temporary storage and safe-keeping of electrical plug connectors in an efficient and streamlined manner, without requiring special sheathing on the electrical leader and without requiring the user to employ a special plug configured to the shape and function of the plug protective device.

Description of the Prior Art

Devices acting to protect and temporarily store electrical plug connectors, both patented and unpatented, have been known and used for a number of years. The following U.S. Patents are examplary of the prior art in this field. They are:

| U.S. Pat. No. | Inventor |
|---|---|
| 3,577,115 | Whitright |
| 4,333,698 | Herbert |
| 3,176,257 | Introvigne |

U.S. Pat. No. 3,577,115 to Whitright discloses an Electrical Connector Storing Device, consisting of an inverted hood and a spring clip which holds onto the electrical cord after the connector is inserted into the hood. This action holds the connector in place.

U.S. Pat. No. 4,333,698 to Herbert teaches a Cover for Truck-Trailer Male Electrical Plugs and consists of a hollow body made of rubber or neoprene. An opening is formed in one side of the body member so that it fits over the plug, covering and protecting it.

U.S. Pat. No. 3,176,257 to Introvigne discloses a Bracket for Holding Trailer Plugs of Tractor-Trailer Vehicles. This invention includes an inverted hood, housing a spring-loaded plunger and internal locking tabs, which hold the plug in place.

Summary of the Invention

This invention relates to trailer connector storage and protective devices and has an object the temporary storage of a male electrical plug connector such that the plug connector is maintained in a sheltered enclosure.

Another object of the present device is to provide a trailer connector storage and protection device which may be utilized with a variety of differently configured male electrical plug connectors.

A still further object of the present device is to provide a method of easy installation of the plug connector protective device such that it may be conveniently mounted on any suitable surface.

DESCRIPTION OF THE PREFERRED EMBODIMENT

Figure 1:
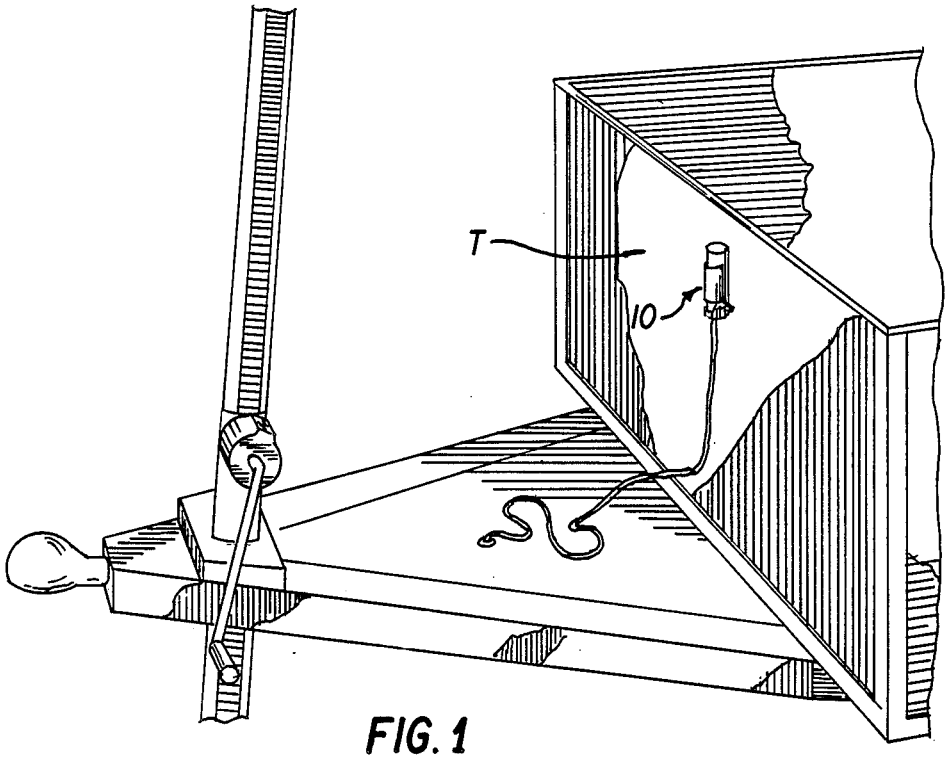
FIG. 1 is a perspective view, illustrating the device in use as mounted, for example, upon a trailer.

Referring now to FIGS. 1 through 4, the device 10 consists of a sectioned tubular retainer housing 12 having a top cap 14 affixed in a weather-proof manner with fastening means 16 to the upper portion thereof and defining a connector cavity C in its lower portion.

An upper retainer housing washer 18 is disposed under the top cap 14 and serves to secure the upper end 17 of a compression spring 20 such as by means of the fastener 19, joining the washer to the top cap.

A lower housing washer 22 secures the lower end 17' of the spring to the upper surface of a resilient disk 26, such as by a fastener 19'. The lower surface 27 of the disk 26 is preferably concave for reasons which will become apparent hereinafter. With the above construction, the disk 26 will be seen to be slidably disposed within the retainer housing cavity C and is normally spring-urged to the lowered, at-rest position of FIG. 2.

The housing 12 includes plurality of orifices 30—30 disposed through its rear surface 12' for the installation of fastening means therethrough to mount the housing 12 on any suitable surface such as a trailer body wall T. The fastening means may be any threaded fasteners or other suitable mounting apparatus for affixing the retainer housing 12 to any surface associated with a trailer, preferably in the upright position as shown in FIG. 1.

Figure 2:
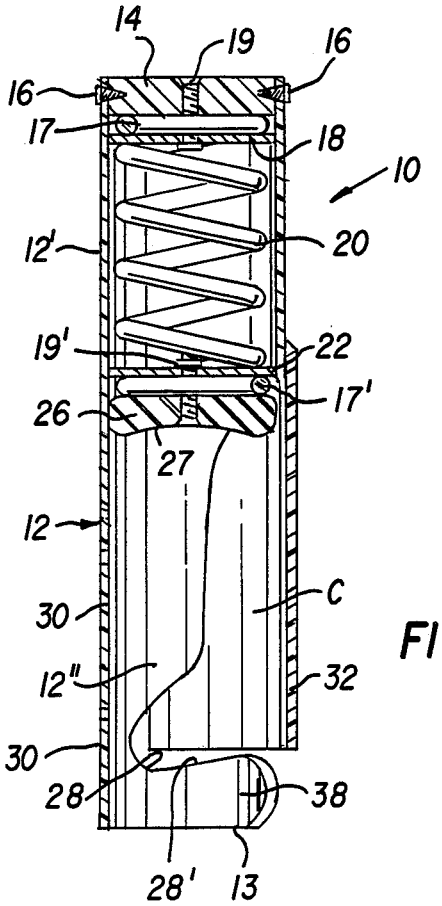
FIG. 2 is a vertical, sectional view of the device as shown in FIG. 1.
Figure 3:
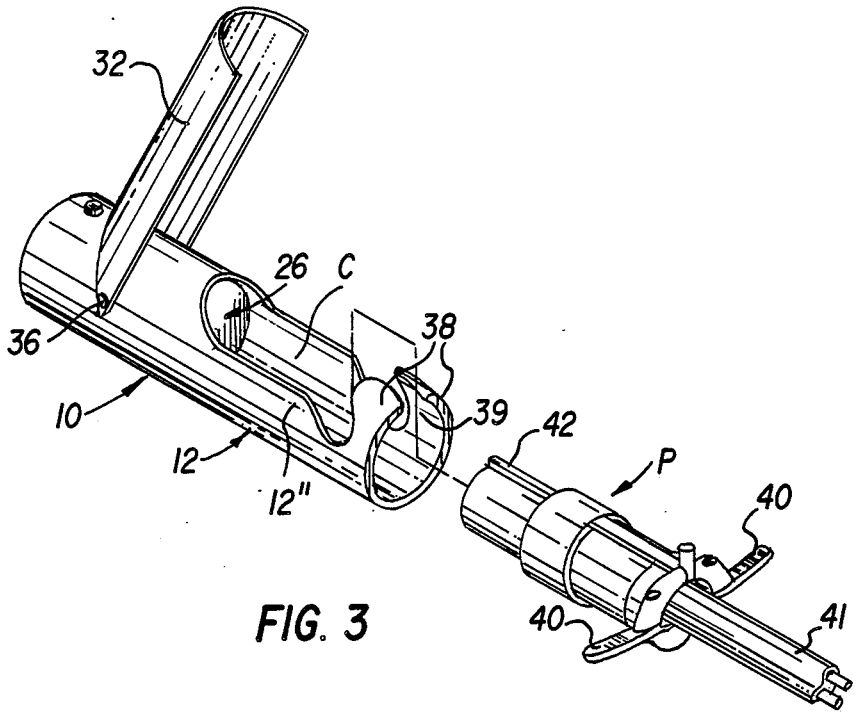
FIG. 3 is an exploded perspective view, illustrating specifically a hinging protective cover and the method by which a typical connector plug is secured within the device's housing.
Figure 4:
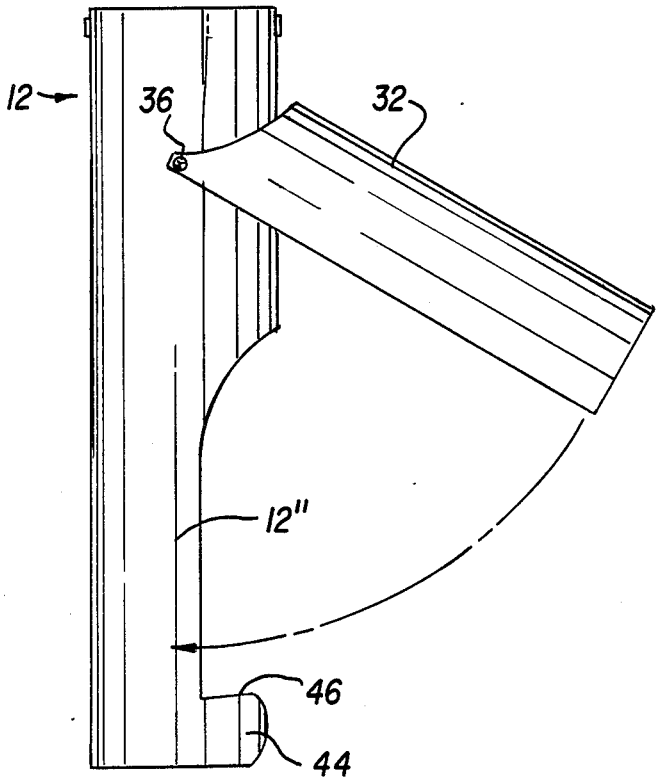
FIG. 4 is an elevational view, illustrating both the hinging means and a bilobial extension on the lower terminal end of the device.

A pivotable sectional tubular protective cover 32 is affixed to the retainer housing by hinge fastening means 36, whereby the cover 32 may be pivotably displaced upwardly or downwardly between the alternate positions of FIGS. 2 and 4 during insertion or removal of a plug connector P with respect to the retainer housing 12.

Concave notches 28—28 formed in the opposite side walls 12"—12" of the housing, adjacent its lower end 13, provide shoulder means or downwardly directed surfaces 28' adapted to accommodate lateral wings or projections 40—40 disposed rearwardly of the open, free end 42 of a connector plug P.

The housing side walls 12"—12" will be understood to permit free passage therebetween of a plug P while the bottom housing extensions 38—38 project closer together, providing a gap 39 therebetween, suitable to allow passage of a connector plug cable 41.

FIG. 4 illustrates an alternative embodiment of the invention, wherein the concave notches 28 are replaced by extensions 44 defining rearwardly and downwardly directed surfaces or shoulders 46 for supporting the lateral projections 40 of a male electrical plug connector P installed in the retainer housing 12.

In the use of the device according to the present invention, the free end 42 of a plug P is inserted into the housing cavity C and urged upwardly against the force of the spring 20 until the plug wings 40—40 are above the extensions 38 or 44. Then the cable end of the connector may be moved into the cavity C to position the wings above the inclined surfaces 28' or 46, following which pressure may be released from the connector. The force of the spring 20 will then urge the concave lower face 27 of the resilient disk 26 to firmly engage the free end 42 of the plug and bias its wings 40—40 into captive engagement with the extensions 38 or 44. The concavity of the disk surface 27 provides for both a self-centering of the plug end 42 and also ensures a more weather-proof engagement therebetween.

As many small and minor changes of the device will occur to those skilled in the art of this invention, the disclosure is only illustrative of the invention and it is desired that the invention should be limited only by the scope of the invention as claimed herein.

What is claimed is:

1. A trailer electrical connector plug storage and protective device, comprising:

a sectional tubular housing having a top cap;

a spring slidably disposed within said housing beneath said top cap; a resilient disk slidably disposed within said housing beneath said spring; said spring normally biasing said disk downwardly;

a sectional elongated protective cover pivotably mounted on said housing;

said housing defining a connector plug-receiving cavity therein; upwardly directed shoulder means adjacent a lower end of said housing and adapted to support lateral projections on a plug connector;

whereby, following insertion of a plug connector within said cavity against the force of said spring, the connector projections are biased against said shoulder means to retain the connector within the device after which said cover is displaceable to a closed position overlying said connector.

2. A trailer electrical plug connector storage and protective device as recited in claim 1, wherein;

said shoulder means comprises notches disposed adjacent the lowermost portion of said sectional tubular retainer housing.

3. A trailer electrical connector plug storage and protective device as recited in claim 1, wherein;

said shoulder means includes a pair of extensions on the lowermost portion of said sectional tubular retainer housing; and said extensions providing rearwardly directed downwardly inclined surfaces;

whereby, the wings of a plug connector disposed upon said surfaces stabilize one end of the plug connector within said cavity as said spring biases against the other end of the connector.

* * * * *